United States Patent [19]

Garter

[11] 4,406,439

[45] Sep. 27, 1983

[54] POURED CONCRETE FORMING SYSTEM FOR SPA POOLS

[76] Inventor: Max J. Garter, 2147 7th St., Grand Rapids, Mich. 49504

[21] Appl. No.: 260,587

[22] Filed: May 6, 1981

[51] Int. Cl.[3] ..... B29C 11/00

[52] U.S. Cl. ..... 249/64; 249/10; 249/120; 249/122; 249/126; 249/160; 249/DIG. 3; 264/32; 264/DIG. 44; 52/169.7; 52/742

[58] Field of Search ..... 52/169.7, 742, 744, 52/745; 264/32, 31, 35, DIG. 44; 249/63, 64, 10, 72, 74, 79, 119, 120, 122, 126, 142, 144, 34, 157, 160, 216, 163, 165, 166, 184, 185, DIG. 3

[56] References Cited

U.S. PATENT DOCUMENTS

| | | | |
|---|---|---|---|
| 676,355 | 6/1901 | Dorward | 249/184 |
| 850,667 | 4/1907 | Mitchell | 249/184 |
| 1,170,049 | 2/1916 | Cunningham | 249/49 |
| 1,623,882 | 4/1927 | McWilliams et al. | 249/50 |
| 1,734,773 | 11/1929 | Murray | 249/181 |
| 1,997,232 | 4/1935 | Richards | 249/185 |
| 2,166,632 | 7/1939 | Hardesty et al. | 405/133 |
| 2,485,850 | 10/1949 | Si Hon | 249/165 |
| 2,596,573 | 5/1952 | Luebkeman | 264/DIG. 44 |
| 2,873,505 | 2/1959 | Sheldon | 264/34 |
| 2,887,759 | 5/1959 | Brownell, Jr. | 264/31 |
| 3,015,191 | 1/1962 | Lucchesi | 52/169.7 |
| 3,031,801 | 5/1962 | Leuthesser | 29/428 |
| 3,729,165 | 4/1973 | Trimble | 249/184 |
| 4,060,946 | 12/1977 | Lang et al. | 249/DIG. 3 |
| 4,142,337 | 3/1979 | Holcomb | 264/35 |

*Primary Examiner*—Donald E. Czaja
*Assistant Examiner*—Joel S. Baden
*Attorney, Agent, or Firm*—Price, Heneveld, Huizenga & Cooper

[57] ABSTRACT

A poured concrete forming system for spa pools, and the like, comprises a form having two collapsible form members each having a closed perimeter. The lower form is shaped to fit within the perimeter of the upper form, and is positioned directly thereunder. A reinforcing grid is mounted within the upper form to securely retain the upper form panels in the preselected configuration, and also suspendingly supports the lower form. The assembled forms are set into a reservoir, such as a hole in the ground, and concrete may be poured about the form to create a monolithic spa pool construction.

29 Claims, 7 Drawing Figures

POURED CONCRETE FORMING SYSTEM FOR SPA POOLS

BACKGROUND OF THE INVENTION

The present invention relates to poured concrete forming systems, and in particular to a form for constructing poured concrete spa pools.

Spa pools, such as hydrotherapy spas, hot tubs, whirlpool spas, and other similar structures, are becoming increasingly popular, and typically include a mechanism to produce hot, swirling water in a small reservoir, and have a bench on which the user sits in a partially immersed state. Such spa pools can be placed either indoors or outdoors, and are now in high demand by individuals for installation at their private residences. This new market has created an increased need for a standardized spa pool, which can be constructed with reduced time, cost, and complexity.

Fiberglass spa pools, as well as other multi-piece, kit-type constructions, are presently known in the art. However, these structures require substantial installation skill, and are not generally considered "permanent" pools, at least when compared with poured concrete spa pools. Some purchasers insist upon the custom, permanent appearance provided by poured concrete pools.

Heretofore, poured concrete spa pools have been fabricated by using a three-step process. The first step is to pour a flat pool bottom, and allow it to fully cure. Upstanding wall forms are then set about the periphery of the pool bottom to form the side wall of the pool. The pool side wall is then poured, and allowed to fully cure. The side wall forms are then stripped, and a second set of upstanding forms is set on the pool bottom, around the interior of the side wall to form the bench. The bench is then poured, allowed to fully cure, and the second set of forms is removed. Metal ties are typically used to interconnect the three pours of concrete, and are also used to hold the form panels together.

One major problem associated with this type of construction technique is that the workmen must be dispatched to the construction site at least three separate times, thereby resulting in substantial travel expenses, and an inefficient use of manpower. Since spa pools are rather small, the time required to pour either the bottom, the side wall, or the seat of the pool is not very great, and does not constitute a full day's work. Hence, workers must be sent out to the construction site, where they pour one of the three pool elements, and then must pack up and leave for a second job to allow the last poured section of the pool to cure before proceeding further. This is a very inefficient construction process, and requires very careful scheduling of work load.

Further, because the pool bottom, side wall, and seat are individually rather small, and therefore do not require a great deal of concrete, concrete suppliers demand maximum price for these small quantities of concrete. Hence, in addition to the inefficient use of labor, the present three-step construction technique requires unusually expensive materials. Also, if metal ties are used to hold the form panels together, the body portions of the ties which are left in the concrete have a tendency to rust very quickly due to exposure to moisture from the spa pool. This causes unsightly discoloration of the pool and in time can result in leaks.

SUMMARY OF THE INVENTION

One aspect of the present invention is a forming system for poured concrete spa pools, which permits the installer to construct the pool in one, semi-continuous pour, thereby greatly increasing labor efficiency, and decreasing material costs. The system includes a form, comprising upper and lower form members, each having a closed perimeter with a preselected configuration, and an exterior surface adapted to mold concrete thereabout. The lower form is shaped to fit within the periphery of the upper form, and is positioned directly therebelow to form the bench portion of the pool. Each of the form members has a collapsible, multi-panel construction, with means for detachably interconnecting each individual panel to retain the same in the preselected configuration during pouring of the concrete, and to permit stripping of the panels after the concrete has at least partially cured. The lower form is retained in its proper position by suspending the lower form from the upper form. Wet concrete is poured around the entire form to mold the pool in substantially a single pour, thereby producing a very strong, leakproof monolithic spa pool construction. Preferably, the form includes a reinforcing grid disposed within the upper form, which positively supports all of the form panels in their preselected configuration, and also positions the lower form beneath the upper form. Since the lower form is suspended in place under the upper form, no further positioning between the two forms is required at the construction site, and the need for form ties is eliminated thereby eliminating the rusting and leakage problems associated with form ties.

Another aspect of the present invention is a method for constructing poured concrete spa pools, and includes forming a reservoir, such as a hole in the ground, in which to retain wet concrete. A form is provided having an upper and lower multi-piece, or otherwise collapsible form members, each with a closed perimeter, and means for suspending the lower form member beneath the upper form member. The form is set in the center of the reservoir to form a generally annularly shaped gap therebetween. The form is leveled, and vertically adjusted so that the lower edge of the lower form member is spaced upwardly from the bottom of the reservoir. Cement is poured into the annular gap to fill the reservoir to a height substantially equal to the lower edge of the lower form member, thereby pouring the floor of the spa pool. The floor is allowed to partially cure for a few minutes, and additional cement is then added to fill the reservoir to a height substantially equal to the top edge of the lower form, thereby pouring the bench portion of the spa pool. The additional cement is partially cured for a few extra minutes, and the final pour is made to form the pool side wall. The three pours are sufficiently close together in time that they are nearly continuous, and result in a monolithic construction.

The principal objects of the present invention are to provide a very efficient and relatively low-cost system for forming poured concrete spa pools. The forming system permits the pool to be poured in a single, semi-continuous pour, thereby resulting in a monolithic construction which is leakproof, as well as extremely strong and durable. The forming system reduces both the cost of materials and labor, yet achieves a neat, attractive, and permanent appearance. Further, the forming system permits the pool to be accurately set and leveled in the ground.

These and other features, advantages, and objects of the present invention will be further understood and appreciated by those skilled in the art by reference to the following written specification, claims, and appended drawings.

DETAILED DESCRIPTION OF THE PREFERRED EMBODIMENTS

Figure 2:
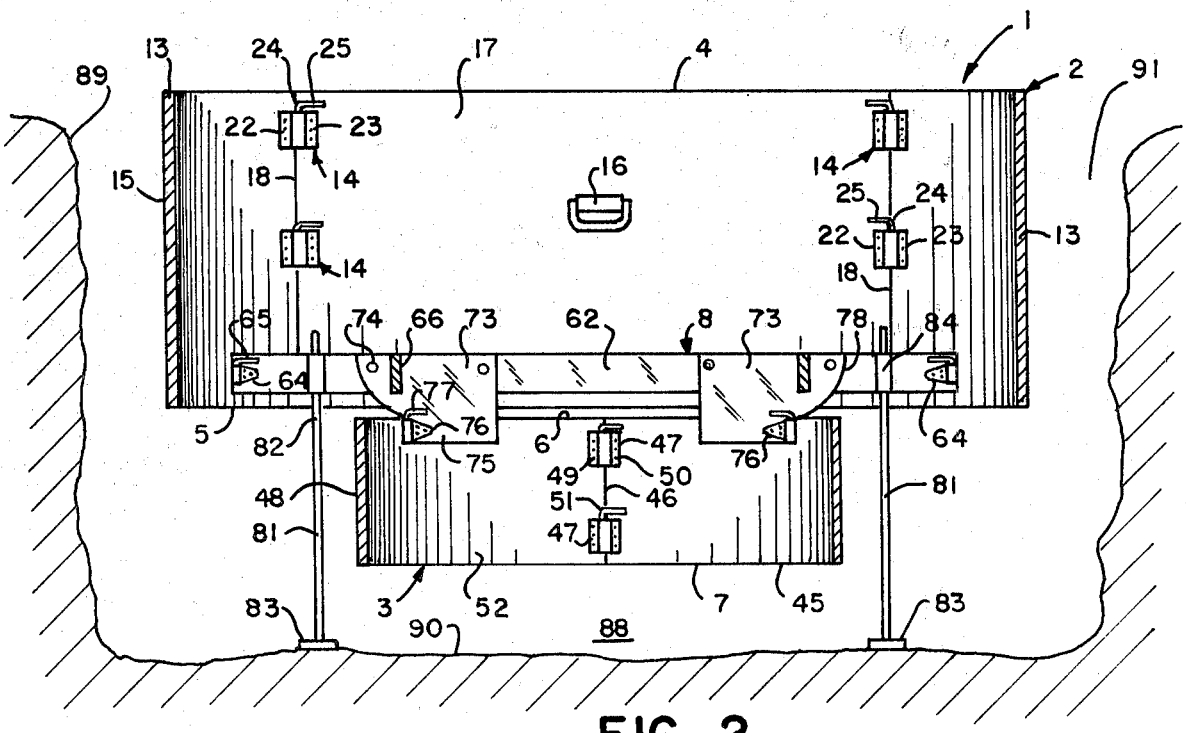
FIG. 2 is a vertical cross-sectional view of the form, taken along the line II—II, FIG. 1, and is shown positioned in a hole in the ground.

For purposes of description herein, the terms "upper", "lower", "right", "left", "rear", "front", "vertical", "horizontal", and derivatives thereof shall relate to the invention as oriented in FIG. 2. However, it is to be understood that the invention may assume various alternative orientations, and step sequences, except where expressly specified to the contrary.

The reference numeral 1 (FIG. 1) generally designates a form used in a concrete forming system embodying the present invention. Form 1 comprises upper and lower members 2 and 3 respectively, each having a closed perimeter with an open top, and an open bottom 4–5 and 6–7. Form members 2 and 3 are stacked vertically, with the lower form 3 shaped to fit within the perimeter of the upper form 2. A reinforcing grid 8 is mounted within upper form 2 to securely retain the upper form panels in their preselected configuration, and also suspends lower form 3 directly beneath the upper form.

Upper form 2 is collapsible, and comprises a plurality of panels 13, which are shaped to be assembled in a generally end-to-end relationship to define a closed perimeter with a preselected configuration. Latches 14 detachably interconnect the ends of panels 13 to retain the same in place during the pouring of the concrete, and to permit the panels to be disassembled and stripped after the concrete has cured. In the illustrated example, upper form 2 has a circular plan shape, comprising four panels 13, each of which has an arcuate configuration. Panels 13 have a height in the nature of fourteen inches, and when assembled, define a vertically extending cylinder having an outside diameter of approximately six feet four inches. Panels 13 have an exterior surface 15 which is relatively flat and smooth, and particularly adapted to form concrete thereagainst. Panels 13 can be constructed of any suitable material, such as plywood, aluminum, or the like. In this example, panels 13 are constructed of plywood, with a slick, waterproof laminate such as that known in the trade as Formica, adhered to the exterior surface. Preferably, handles 16 are attached to the interior surface 17 of panels 13 to facilitate grasping, and manual transport. The end edges 18 of panels 13 are straight, and adapted to sealingly abut with the mating portion of the form 1.

Latches 14 detachably interconnect the ends of adjacent panels, and in the present example, as best illustrated in FIG. 2, comprise hinges having mating hinge plates 22 and 23, and a removable pin 24 with a laterally extending handle portion 25 to facilitate grasping. Each hinge 14 is mounted on the interior surface 17 of upper form 2, with opposing hinge plates 22 and 23 attached to opposite ends of adjacent form members by conventional fasteners, such as wood screws 26. In this example, three pairs of hinges 14 are spaced vertically along each panel joint to insure a close, sealing fit between the end edges 10 of panels 13.

Figure 3:
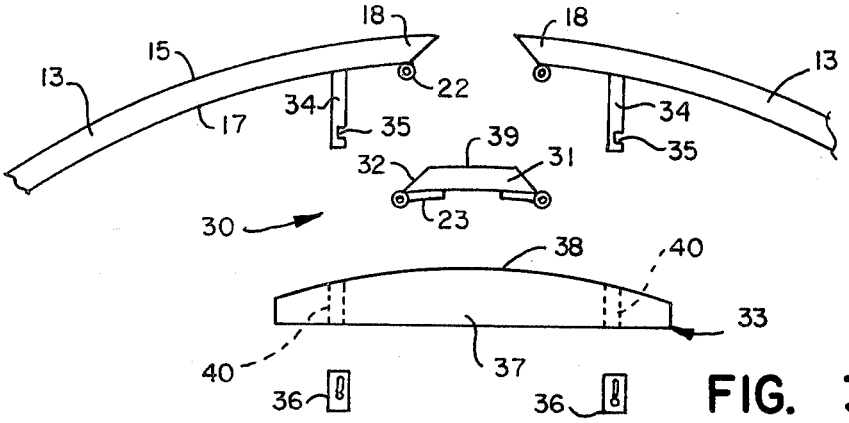
FIG. 3 is a fragmentary, exploded view of a key portion of the form.
Figure 4:
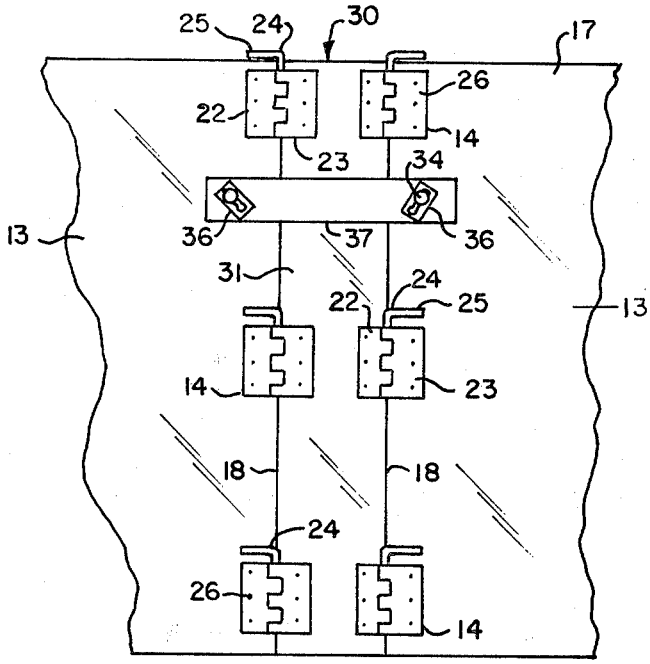
FIG. 4 is an elevational view of the key, shown in an assembled condition.
Figure 5:
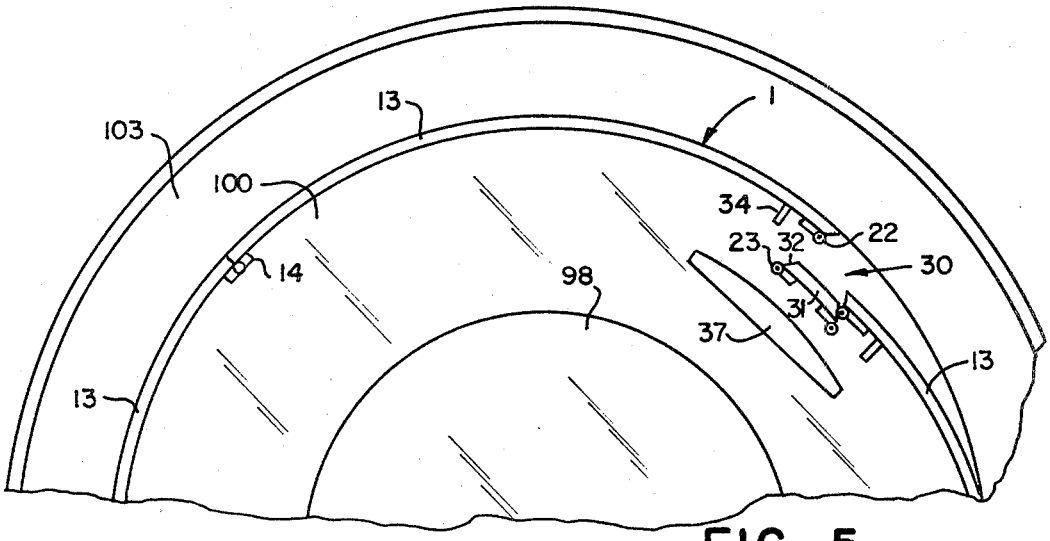
FIG. 5 is a fragmentary, top plan view of the form, shown in a partially disassembled condition after curing.

Upper form 2 also includes a removable key 30 (FIG. 1) to facilitate disassembly and stripping of form panels 13. The illustrated key 30 comprises a vertically extending strip 31 having beveled side edges 32, which angle inwardly toward the exterior surface 15 of the panels. The end edges 18 of adjacent form panels 13 are similarly beveled to mate with the side edges 32 of key 30. Hence, when assembled, key 30 fits between the mating panel ends in a wedge-like manner which is particularly adapted to resist collapse under the hydrostatic pressure of the wet concrete, and also minimized the gap between the abutting edges. The exterior surface 39 of tie panel 31 is smooth, and arcuately shaped to mate with the exterior surface 15 of form panels 13. As best illustrated in FIGS. 3–5, key 30 includes three sets of hinges 14 extending along both side edges 32 on the interior side of the key, with the outer hinge plate attached to the end edges 18 of adjacent form panels 13 in a manner identical to that described above. A wedge lock 33 is also provided at the upper portion of key 30, and comprises a pair of pins 34 anchored in adjacent form panels 13 and projecting inwardly therefrom in a substantially parallel relationship. The ends of pins 34 include a slot 35, adapted to mate with a retainer clip 36. A rigid tie 37 extends between the ends of adjacent form panels 13, and includes an arcuately shaped exterior surface 38 to mate with the interior surface of form panels 13 and tie panel 31. Tie 37 includes a pair of laterally extending apertures 40, shaped to receive pins 34 therethrough. When form 2 is assembled, key 30 is positioned in the gap formed between the associated form panels 13, and is locked in place by hinges 14. Tie 37 is then positioned over pins 34, and clips 36 are engaged over the ends of the pins and locked into notches 35. Preferably, retainer clips 36 are wedge-shaped, such that they can be driven laterally with respect to the pin ends, and thereby securely and positively hold tie 37 against the interior of the key and form panels.

Lower form 3 has a collapsible construction similar to upper form 2, and includes a plurality of form panels 35 detachably interconnected in a generally end-to-end relationship to form a closed perimeter having a preselected configuration. Lower form 3 is shaped to fit within the perimeter of upper form 2, so as to form the bench portion of the spa pool. Preferably, lower form 3 has a shape which is geometrically similar to the shape of upper form 2. In this example, lower form 3 also has a circular plan shape, and includes four arcuately shaped form panels 45. Although the illustrated forms 2 and 3 have a circular shape, they may be constructed in a wide variety of different configurations, such as eliptical, oblong, kidney, and the like to facilitate forming different shapes of spa pools. The ends 46 of form panels 45 are interconnected by detachable latches 47, and the exterior surfaces of form panels 45 are straight and smooth, so as to form concrete thereagainst, and preferably include a slick, waterproof laminate cover, like upper form panels 13. Latches 47 comprise two pair of spaced apart hinges, substantially identical in construction to hinges 14, with mating hinge plates 49 and 50, and a removable pin 51. Hinges 47 are mounted on the interior surface 52 of form panels 45 by suitable fasteners 53. Form panels 45 have a height in the nature of fourteen inches, and when assembled, form a cylinder having an outside diameter of approximately forty-four inches. Lower form 3 also includes a key 54, which is substantially identical with key 30, and includes a panel 55 with beveled side edges 32 to mate with similarly angled end edges 46 of adjacent form panels 45. A tie 58 positively holds key 54 in position with a pin and wedge lock arrangement similar to key 30, as described above.

Figure 1:
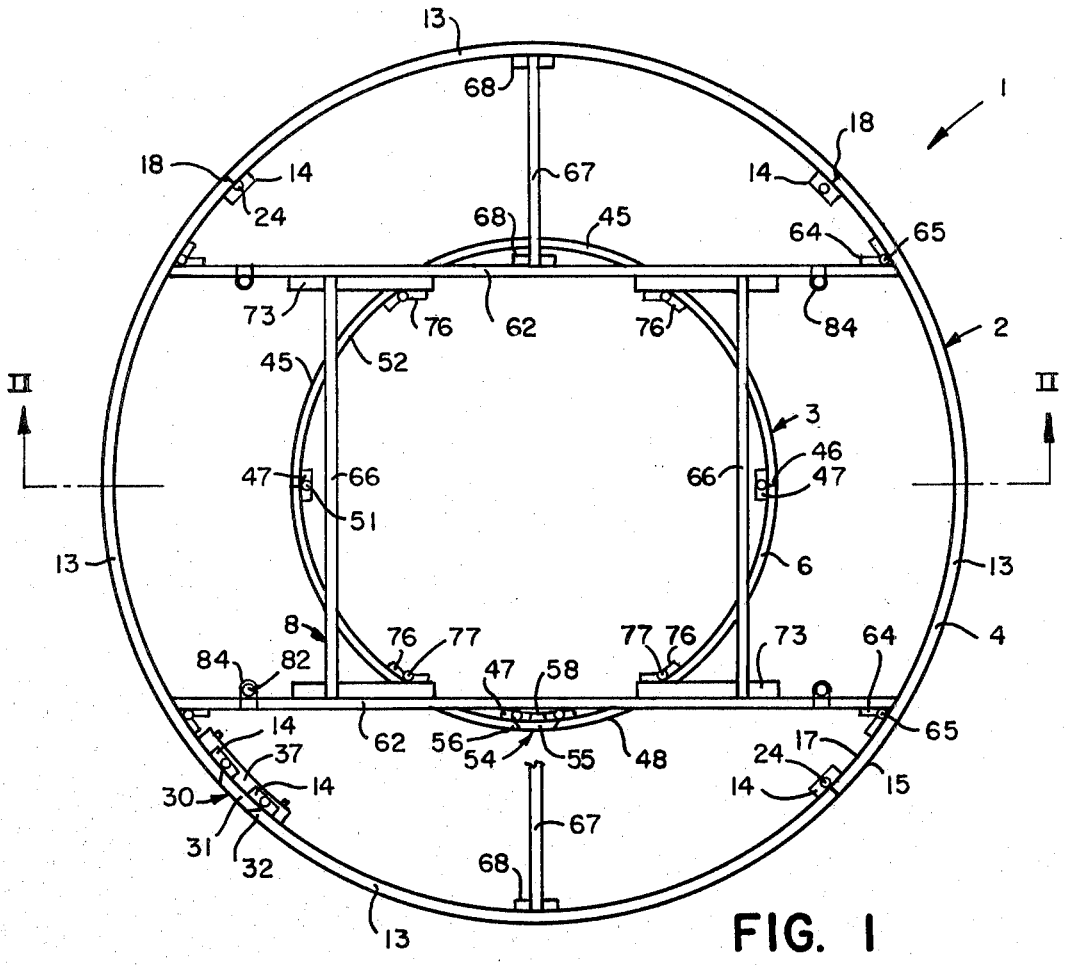
FIG. 1 is a top plan view of a concrete form embodying the present invention.

With reference to FIGS. 1 and 2, reinforcing grid 8 is positioned within upper form 2, and is connected with each of upper form panels 13 to securely retain the panels in their circular configuration while the concrete is being poured. In this example, reinforcing grid 8 comprises a pair of elongate beams 62, which extend between oppositely positioned form panels 13. The ends of beams 62 are detachably connected to the interior surface of panels 13, adjacent the lower edge 5 thereof, by hinges 64 with removable pins 65. Beams 62 are rigid, and can be constructed of any suitable material, such as wood, aluminum, or the like. Beams 62 extend across upper form 2 in a substantially parallel relationship, and are spaced apart a distance which is less than the diameter of lower form 3, such that they intersect the lower form in plan view, as illustrated in FIG. 1. A pair of laterally extending cross braces 66 extend between the interior faces of beams 62 and have their ends slidingly received in U-shaped notches in blocks 73 for detachably connecting braces 66 and beams 62 to form a rigid, grid-like support structure. Braces 66 extend between beams 62 in a substantially parallel fashion, and are spaced apart a distance which is less than the diameter of lower form 3, such that they intersect the lower form in plan view, as illustrated in FIG. 1, in a manner similar to beams 62. Outrigger braces 67 extend radially outwardly from the medial portions of beams 62, to the interior surface of adjacent form panels 13. The ends of braces 67 are detachably connected with beams 62 and form panels 13 by upwardly opening, U-shaped blocks 68. When assembled, reinforcing grid 8 securely holds each form panel 13 in its circular relationship with the other form panels against the radially inwardly oriented forces caused by the hydrostatic pressure of the wet concrete.

Reinforcing grid 8 is also attached to lower form 3 and suspends the same directly beneath upper form 2. In this example, reinforcing grid 8 positions lower form 3 in a vertically aligned or coaxial relationship with upper form 2, thereby defining an annularly shaped space therebetween. Four plates 73 are attached to the interior surfaces of beams 62 by conventional fasteners 74, and extend downwardly therefrom past the upper edge 6 of the lower form 3. The lower edges 75 of plate 73 are detachably connected to the interior surface 52 of form panels 45 by hinges 76 with removable pins 77. Plates 73 are thereby attached to an associated one of the form panels 45 to provide a very secure support therefor. Preferably, plates 73 suspend lower form 3 from upper form 2 at a level such that the upper edge 6 of the lower form is spaced slightly below the lower edge 5 of the upper form for purposes to be described in greater detail hereinafter. The outer edges 78 of plates 73 are curved arcuately inwardly toward lower form 3 to prevent obstructing the forming of the pool bench. The lower form panels 45 are preferably attached to support plates 73 at a location adjacent to the center of the panel for maximum supporting strength. In the example illustrated in FIG. 1, the joints between the ends of adjacent panels in upper form 2 are off-set approximately 45 degrees from the four joints in lower form 3. Since lower form 3 is supported from its upper end by reinforcing grid 8, the two forms are mutually positioned and retained in place without requiring any form ties between the upper and lower forms.

In the illustrated example, form 1 (FIGS. 1 and 2) is supported on four legs 81, having threaded upper ends. The lower ends of legs 81 are abuttingly supported on blocks 83. Threaded sleeves 84 are mounted on the beams 62 of reinforcing grid 8, and receive the threaded upper ends of legs 81 therein, so as to provide means for leveling and vertically adjusting the form 1.

The form 1 is used to construct a spa pool in the following manner. For in-ground installations, a hole 88 (FIG. 2) is excavated in the earth 89, with a shape slightly larger than form 1. In the illustrated example, hole 88 is cylindrical in shape, in the nature of thirty-six inches deep, and has a diameter of approximately eight feet, so that the bottom and side walls of the pool will be approximately eight and ten inches thick, respectively. Form 1 is then set into hole 88, such that legs 81 bodily support the form above the bottom 90 of the hole on blocks 83. Form 1 is centered in hole 88 so that the aperture or gap 91 formed between the form and the side wall of the hole is substantially uniform about the periphery of the form. Since the upper and lower forms 2 and 3 are already interconnected in their desired relationship by reinforcing grid 8, no further adjustment between the forms is required at the construction site, and the level, concentricity and height of each form is adjusted simultaneously. Legs 81 are then adjusted so that the lower edge 7 of lower form 3 is spaced approximately eight inches from the bottom 90 of the hole, and the form is level. A conventional curb-type of form 85 (FIG. 6) may be set about the upper edge of hole 88, and is anchored in place by stakes 86 to form a rim portion of the spa pool. In this example, rim form 85 is rounded inwardly, and is set at an elevation substantially commensurate with the top edge 4 of upper form 2. The plumbing and other utilities such as water lines **95*a* and air ducts 95*b* are connected with form 1 so that they can be poured integrally with the spa pool. U-shaped reinforcing bars 96** are positioned in the center of the gap to provide the finished spa pool with greater structural strength.

Concrete is poured about the set form 1 in three, sequential, nearly continuous pouring steps. There is a short delay or pause between the three pouring steps which is long enough only to permit the concrete to stiffen or cure sufficiently that the concrete will not move or shift under the hydrostatic force applied thereto by the next pour. These delays are typically only five to fifteen minutes apiece, so that the cement truck can practically remain in place at the construction site throughout the entire pouring process. The sequence of pouring steps complying with the above criteria is referred to hereinafter by the term "semi-continuous".

Figure 6:
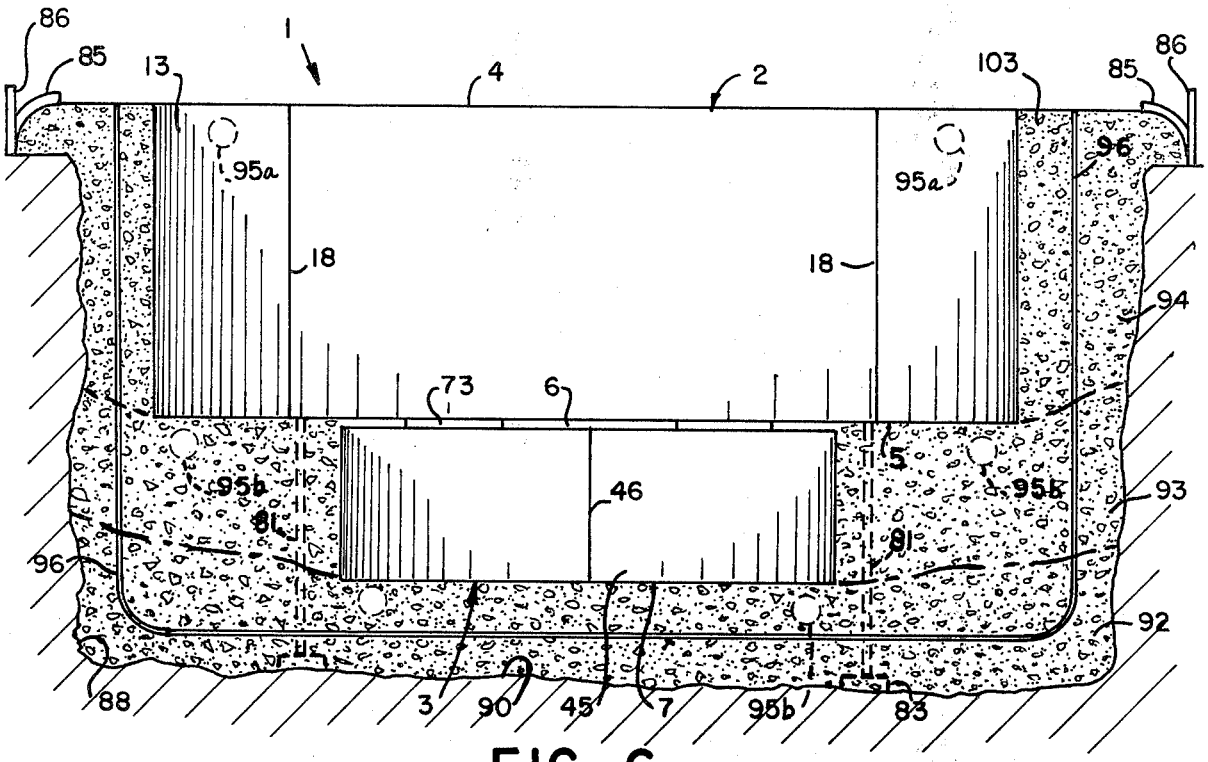
FIG. 6 is a side elevational view of the form after the concrete has been poured.

As best illustrated in FIG. 6, a first pour is made, filling hole 88 up to the lower edge 7 of lower form 3, with a suitable cementious construction material, which shall hereinafter be referred to as "concrete". This volume of concrete is designated by the reference numeral 92, and is preferably rather dry or viscous, in the nature of a three to four inch slump. The first pour is permitted to cure just slightly so that the concrete will not move or shift upwardly into the interior of lower form 3 under the hydrostatic force applied thereto by the next pour. A hardening accelerator, such as calcium chloride is preferably used to speed up the curing process. Normally, curing to the extent required to prevent shifting will take only about five to fifteen minutes under most ambient conditions. A second pour 93 is made into the reservoir, immediately after the five to fifteen minute cure of the first pour 92, filling the same up to the lower edge 5 of upper form 2 with a similarly viscous mix of concrete (i.e., 3–4 inch slump, and with a hardening accelerator). The second pour 93 is preferably vibrated to insure integral bonding with the first pour 92, and is allowed to partially cure (normally five to fifteen minutes), so that the hydrostatic pressure applied by the next and final pour will not force the concrete of second pour 93 up between the annular gap formed between the upper and lower forms 2 and 3. It should be noted that when the second pour is made, the first pour 92 is sufficiently wet or uncured that it will bond with the second pour 93 to produce a monolithic or integral construction. After the second pour 93 has cured sufficiently, the third and final pour 94 is made, filling inbetween the arcuate curb form 85 and the upper edge 4 of upper form 2. The third pour preferably uses a somewhat less viscous concrete, in the nature of a 6–7 inch slump. The three pours 92–94 are then vibrated, and are sufficiently uncured that they will bond together to form a monolithic construction. Typically, all three pours are made within approximately 45 minutes so that the pouring process is semi-continuous and the concrete truck is not delayed unduly at the construction site. After the final pour, the concrete is cured approximately ten to fifteen minutes until it is in a relatively stiff condition which is suitable for finishing.

Reinforcing grid 8 is then removed from form 1 by detaching cross braces 66, outrigger braces 67, and all of the hinge pins 65. Beams 62 are then moved inwardly toward the center of upper form 2, and lifted up out of the form. Support legs 82 remain attached to beams 62, and are pulled out of the uncured concrete when reinforcing grid 8 is removed from the form.

The pool bottom, rim, and bench seat are then finished, by conventional means such as manual troweling. The apertures formed in the pool bench when legs 82 are removed are then filled in and smoothed over. A semi-circular panel may be placed on the bottom of the pool to facilitate the initial finishing step. The upper and lower forms 2 and 3 remain in position during the finishing of the exposed concrete surfaces, and are not stripped until the concrete has solidified fully, in the nature of six to eight hours.

After the concrete has fully solidified, lower form 3 is then disassembled by removing key 54, and all hinge pins 51. Form panels 45 are stripped inwardly, as illustrated in FIG. 5. Next, upper form 2 is removed in a similar fashion, detaching key 30, removing pins 24, and stripping form panels 13 inwardly. The pool is then completed by installing the plumbing and other utilities, painting, tiling, and the like.

Figure 7:
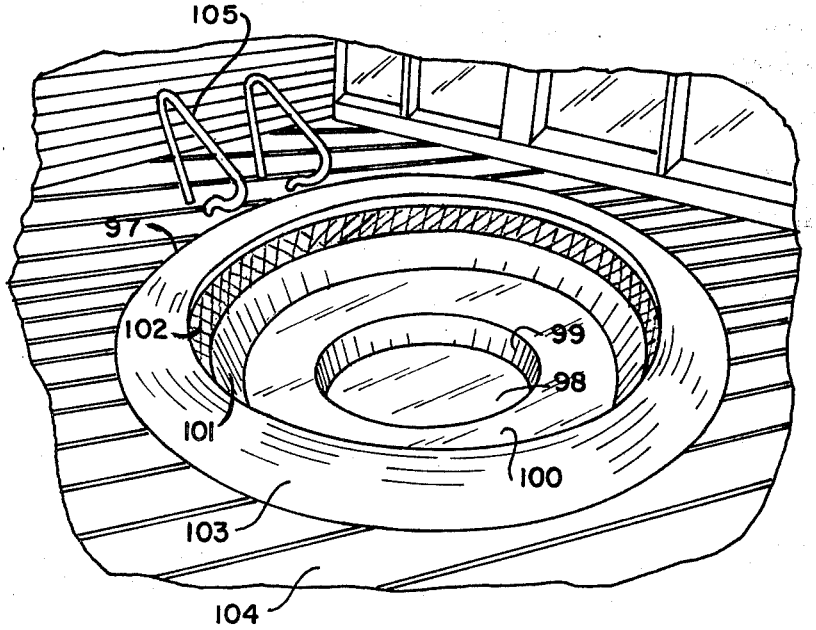
FIG. 7 is a perspective view of a spa pool formed by the present forming system, shown installed in a patio deck.

As best illustrated in FIG. 7, the finished spa pool 97 comprises a bottom 98 formed by the open lower end of lower form 3, and an upstanding bench wall 99 formed by the exterior surface of lower form 3. A bench seat 100 is formed by the annular space between the upper edge 6 of the lower form 3, and the lower edge 5 of the upper form 2. The slight difference in elevation between edges 5 and 6 provides a downwardly slant or incline to the bench seat 100 which insures proper drainage when the pool is emptied for cleaning, or the like. The pool side wall 101 provides the back of the bench, and is formed by the exterior surface of upper form 2. Tile or other decorative materials 102 may be inlaid along the upper edge of the spa pool side wall 101. A rounded rim 103 is formed about the periphery of the pool by curb form 85, and provides a neat, finished appearance. Spa pool 97 may be installed completely in-ground, as illustrated in FIG. 6, or may be positioned partially in-ground, with the upper edge extending through a deck 104, as shown in FIG. 7. Hand rails 105 and other similar accessories can be added to facilitate use of the spa pool 97.

The present forming system greatly reduces the labor and expense involved in installing poured concrete spa pools, by providing a means to construct the same in a single, semi-continuous pour. This method produces a monolithic construction which not only reduces labor and material cost, but is extremely durable, and has a neat, finished appearance. The collapsible forms accurately position the pool in place, require no form ties, and can be stripped relatively quickly for use at another site.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. A form for making poured concrete spa pools and the like, comprising:

first and second form members, each having a closed perimeter with a preselected configuration, and an exterior surface adapted to mold concrete thereabout; said second form member being shaped to fit within the perimeter of said first form member; each of said form members having a collapsible construction, comprising a plurality of form panels with means for detachably interconnecting said form panels to retain the same in said preselected configuration during pouring of the concrete, and to permit stripping said form panels after the concrete has at least partially cured;

means surrounding said first and second form members for forming concrete between said form members and said forming means; and means for suspending said second form member directly below said first form member, whereby wet concrete is poured between said forming means and said entire form to create a monolithic spa pool construction.

2. A form as set forth in claim 1, wherein:

said second form member is connected with and suspended from said first form member.

3. A form as set forth in claim 2, including:
a reinforcing grid disposed within the interior of said first form member, and being detachably connected with each panel of said first form member to positively support said form panels in said preselected configuration.
4. A form as set forth in claim 3, wherein:
said second form member is connected with said reinforcing grid, thereby constituting said suspending means.
5. A form as set forth in claim 4, including:
means for connecting each panel of said second form member with said reinforcing grid to positively support the same in said preselected configuration.
6. A form as set forth in claim 5, wherein:
said second form panels-to-reinforcing grid connecting means is detachable.
7. A form as set forth in claim 6, wherein:
said upper form member includes an open lower end, and said lower form member includes an open upper end for forming a spa pool bench seat therebetween.
8. A form as set forth in claim 7, wherein:
said lower form includes an open lower end for forming a spa pool bottom therewithin.
9. A form as set forth in claim 8, wherein:
said upper form includes an open upper end.
10. A form as set forth in claim 9, wherein:
said first and second form members each have upper and lower edges; and
said suspending means positions the upper edge of said second form member slightly below the lower edge of said first form member.
11. A form as set forth in claim 10, wherein:
the configuration of said first form member is geometrically similar to the configuration of said second form member.
12. A form as set forth in claim 11, wherein:
said first and second form members are vertically coaxial.
13. A form as set forth in claim 12, wherein:
said first and second form members have a circular shape.
14. A form as set forth in claim 13, wherein:
said first form member includes a removable key to facilitate stripping the same.
15. A form as set forth in claim 14, wherein:
said second form member includes a removable key to facilitate stripping the same.
16. A form as set forth in claim 15, including:
at least three legs connected with and depending from an interior portion of one of said first and second form members for supporting said form above a ground surface.
17. A form as set forth in claim 1, wherein:
said lower form includes an open lower end for forming a spa pool bottom therewithin.
18. A form as set forth in claim 1, wherein:
said upper form includes an open upper end.
19. A form as set forth in claim 1, wherein:
said first and second form members each have upper and lower edges; and
said suspending means positions the upper edge of said second form member slightly below the lower edge of said first form member.
20. A form as set forth in claim 1, wherein:
the configuration of said first form member is geometrically similar to the configuration of said second form member.
21. A form as set forth in claim 1, wherein:
said first and second form members are vertically coaxial.
22. A form as set forth in claim 1, wherein:
said first and second form members have a circular shape.
23. A form as set forth in claim 1, wherein:
said first form member includes a removable key to facilitate stripping said first form panels.
24. A form as set forth in claim 1, wherein:
said second form member includes a removable key to facilitate stripping said second form panels.
25. A form as set forth in claim 1, including:
at least three legs connected with and depending from an interior portion of one of said first and second form members for supporting said form above a ground surface.
26. A form for making poured concrete spa pools and the like, of the type having a bottom, an upstanding side wall, and a bench, said form comprising:
first and second sets of form panels, each adapted to be assembled in a generally end-to-end relationship to define first and second form members respectively; said first and second form members each having a closed perimeter with a preselected configuration, an open bottom, an open top, and an exterior surface adapted to mold concrete thereabout; said second form member being shaped to fit within the perimeter of said first form member;
means for detachably interconnecting the form panels of each of said sets of form panels to retain the same in said preselected configuration during pouring of the concrete, and to strip the form panels after the concrete has at least partially cured; and
means for suspending said second form member from said first form member, and positioning the same directly below and depending from said first form member, whereby said form is adapted to be set into a reservoir, and concrete poured about the exterior surfaces of said first and second form members to mold a monolithic spa pool construction having an integral bottom, bench, and side wall.
27. A form for making poured concrete spa pools and the like, of the type having a bottom, an upstanding side wall, and a bench, said form comprising:
a first set of form panels shaped to be assembled in a generally end-to-end relationship to define a first form member having a closed perimeter with a preselected configuration, an open bottom, and an open top; said first form member having an exterior surface adapted to mold concrete thereabout;
means for detachably interconnecting said first form panels to retain the same in said preselected configuration during curing of the concrete, and to strip said first form panels after the concrete has at least partially cured;
a second set of form panels shaped to be assembled in a generally end-to-end relationship to define a second form member having a closed perimeter with a preselected configuration, an open bottom, and an open top; said second form member being sized to fit within said first form member, and having an exterior surface adapted to mold concrete thereabout;

means for detachably interconnecting said second form panels to retain the same in said preselected configuration during curing of the concrete, and to strip said second form panels after the concrete has at least partially cured;

means for suspending said second form member from said first form member, and positioning the same directly below and depending from said first form member, whereby said form is adapted to be set into a reservoir, and concrete poured about the exterior surfaces of said first and second form members to mold a monolithic spa pool having an integral bottom, bench, and side wall construction.

28. A forming system for making poured concrete spa pools and the like, of the type having a bottom, an upstanding side wall with a rim, and a bench, said forming system comprising:

a first set of form panels shaped to be assembled in a generally end-to-end relationship to define a first form member having a closed perimeter with a preselected configuration, an open bottom, and an open top; said first form member having an exterior surface adapted to mold concrete thereabout;

means for detachably interconnecting said first form panels to retain the same in said preselected configuration during curing of the concrete, and to strip said first form panels after the concrete has at least partially cured;

a second set of form panels shaped to be assembled in a generally end-to-end relationship to define a second form member having a closed perimeter with a preselected configuration, an open bottom, and an open top; said second form member being sized to fit within said first form member, and having an exterior surface adapted to mold concrete thereabout;

means for detachably interconnecting said second form panels to retain the same in said preselected configuration during curing of the concrete, and to strip said second form panels after the concrete has at least partially cured;

means for suspending said second form member from said first form member, and positioning the same directly below and depending from said first form member;

a third set of form panels having means for interconnecting the same in a generally end-to-end relationship to define a third form member having a closed perimeter with a preselected configuration; said third form member having an interior surface adapted to mold concrete therein, and being sized to surround an upper end of said first form member, whereby said first and second form members are adapted to be set into a reservoir, with said third form member positioned about the upper edge of the reservoir, and concrete poured about the exterior surfaces of said first and second form members, and within the interior surface of said third form member to mold a monolithic spa pool construction having an integral bottom, bench, side wall and rim.

29. A form as set forth in claim 28, including:

a reinforcing grid disposed within the interior of said first form member, and being detachably connected with each panel of said first form member to positively support said form panels in said preselected configuration.

* * * * *